US005943705A

United States Patent [19]

Sink

[11] Patent Number: 5,943,705

[45] Date of Patent: Aug. 31, 1999

[54] ATHLETIC EQUIPMENT ATTACHMENT STRAP

[76] Inventor: Michael D. Sink, 4479 Hinshaw Town Rd., Ramseur, N.C. 27316

[21] Appl. No.: 09/036,404

[22] Filed: Mar. 5, 1998

[51] Int. Cl.[6] ..... A41F 3/02

[52] U.S. Cl. ..... 2/338; 128/876; 602/62; 606/203

[58] Field of Search ..... 2/22, 23, 60, 231, 2/232, 233, 240, 300, 309, 311, 338, 270; 128/876; 602/61, 62, 74, 75; 606/201, 203

[56] References Cited

U.S. PATENT DOCUMENTS

| | | | |
|---|---|---|---|
| 3,411,160 | 11/1968 | Le Roux et al. | 2/232 |
| 3,501,774 | 3/1970 | Norman | 2/240 |
| 4,273,130 | 6/1981 | Simpson | 2/338 |
| 4,384,583 | 5/1983 | Speelman et al. | 2/338 |
| 4,700,406 | 10/1987 | Meistrell | 2/232 |
| 4,991,234 | 2/1991 | Greenberg | 2/311 |

*Primary Examiner*—Diana L. Oleksa
*Assistant Examiner*—Katherine Moran

[57] ABSTRACT

An athletic equipment attachment strap for holding athletic equipment in place against a user's body includes elastic and non-elastic portions for providing a comfortable and flexible fit. The preferred embodiment provides a loop attached to an elastic portion and hook and loop fasteners for fastening the non-elastic portions to each other around the loop. In an alternate embodiment, two non-elastic portions are positioned at either end of an elastic portion. The two non-elastic portions include hook and loop fasteners for fastening the two non-elastic portions to each other to form a band for holding a piece of athletic equipment.

6 Claims, 3 Drawing Sheets

ATHLETIC EQUIPMENT ATTACHMENT STRAP

BACKGROUND OF THE INVENTION

1. Field of the Invention

The present invention relates to athletic equipment attachment straps and more particularly pertains to a new athletic equipment attachment strap having elastic and non-elastic portions for holding athletic equipment in place against a user's body.

2. Description of the Prior Art

The use of athletic equipment attachment straps is known in the prior art. More specifically, athletic equipment attachment straps heretofore devised and utilized are known to consist basically of familiar, expected and obvious structural configurations, notwithstanding the myriad of designs encompassed by the crowded prior art which have been developed for the fulfillment of countless objectives and requirements.

Known prior art attachment straps and athletic equipment attachment devices include U.S. Pat. No. 5,581,817; U.S. Pat. No. 4,617,017; U.S. Pat. No. 4,571,245; U.S. Pat. No. 5,147,705; U.S. Pat. No. 4,393,522; U.S. Pat. No. Des.356, 433, PCT Pat. No. WO 90/10395, and PCT Pat. No. WO 94/28986.

While these devices fulfill their respective, particular objectives and requirements, the aforementioned patents do not disclose a new athletic equipment attachment strap. The inventive device includes a strap having elastic and non-elastic portions for providing a comfortable and flexible fit.

In these respects, the athletic equipment attachment strap according to the present invention substantially departs from the conventional concepts and designs of the prior art, and in so doing provides an apparatus primarily developed for the purpose of holding athletic equipment in place against a user's body.

SUMMARY OF THE INVENTION

In view of the foregoing disadvantages inherent in the known types of athletic equipment attachment straps now present in the prior art, the present invention provides a new athletic equipment attachment strap construction wherein the same can be utilized for holding athletic equipment in place against a user's body.

The general purpose of the present invention, which will be described subsequently in greater detail, is to provide a new athletic equipment attachment strap apparatus and method which has many of the advantages of the athletic equipment attachment straps mentioned heretofore and many novel features that result in a new athletic equipment attachment strap which is not anticipated, rendered obvious, suggested, or even implied by any of the prior art athletic equipment attachment straps, either alone or in any combination thereof.

To attain this, the present invention generally comprises a strap having elastic and non-elastic portions for providing a comfortable and flexible fit.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new athletic equipment attachment strap apparatus and method which has many of the advantages of the athletic equipment attachment straps mentioned heretofore and many novel features that result in a new athletic equipment attachment strap which is not anticipated, rendered obvious, suggested, or even implied by any of the prior art athletic equipment attachment straps, either alone or in any combination thereof.

It is another object of the present invention to provide a new athletic equipment attachment strap which may be easily and efficiently manufactured and marketed.

It is a further object of the present invention to provide a new athletic equipment attachment strap which is of a durable and reliable construction.

An even further object of the present invention is to provide a new athletic equipment attachment strap which is susceptible of a low cost of manufacture with regard to both materials and labor, and which accordingly is then susceptible of low prices of sale to the consuming public, thereby making such athletic equipment attachment strap economically available to the buying public.

Still yet another object of the present invention is to provide a new athletic equipment attachment strap which provides in the apparatuses and methods of the prior art some of the advantages thereof, while simultaneously overcoming some of the disadvantages normally associated therewith.

Still another object of the present invention is to provide a new athletic equipment attachment strap for holding athletic equipment in place against a user's body.

Yet another object of the present invention is to provide a new athletic equipment attachment strap which includes a strap having elastic and non-elastic portions for providing a comfortable and flexible fit.

Still yet another object of the present invention is to provide a new athletic equipment attachment strap that provides limited extension of the strap due to the elastic portion while providing a firmer attachment than existing straps that are fully elastic along the entire length of the strap.

Even still another object of the present invention is to provide a new athletic equipment attachment strap that provides at least one non-elastic portion for providing stability and minimizing the total change in length of the strap due to an elastic portion.

Yet even another object of the present invention is to provide a new athletic equipment attachment strap that provides a limited amount of change in length due to an elastic portion, thus providing a secure fit while allowing for some expansion due to the contraction and expansion of muscles during physical activity.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
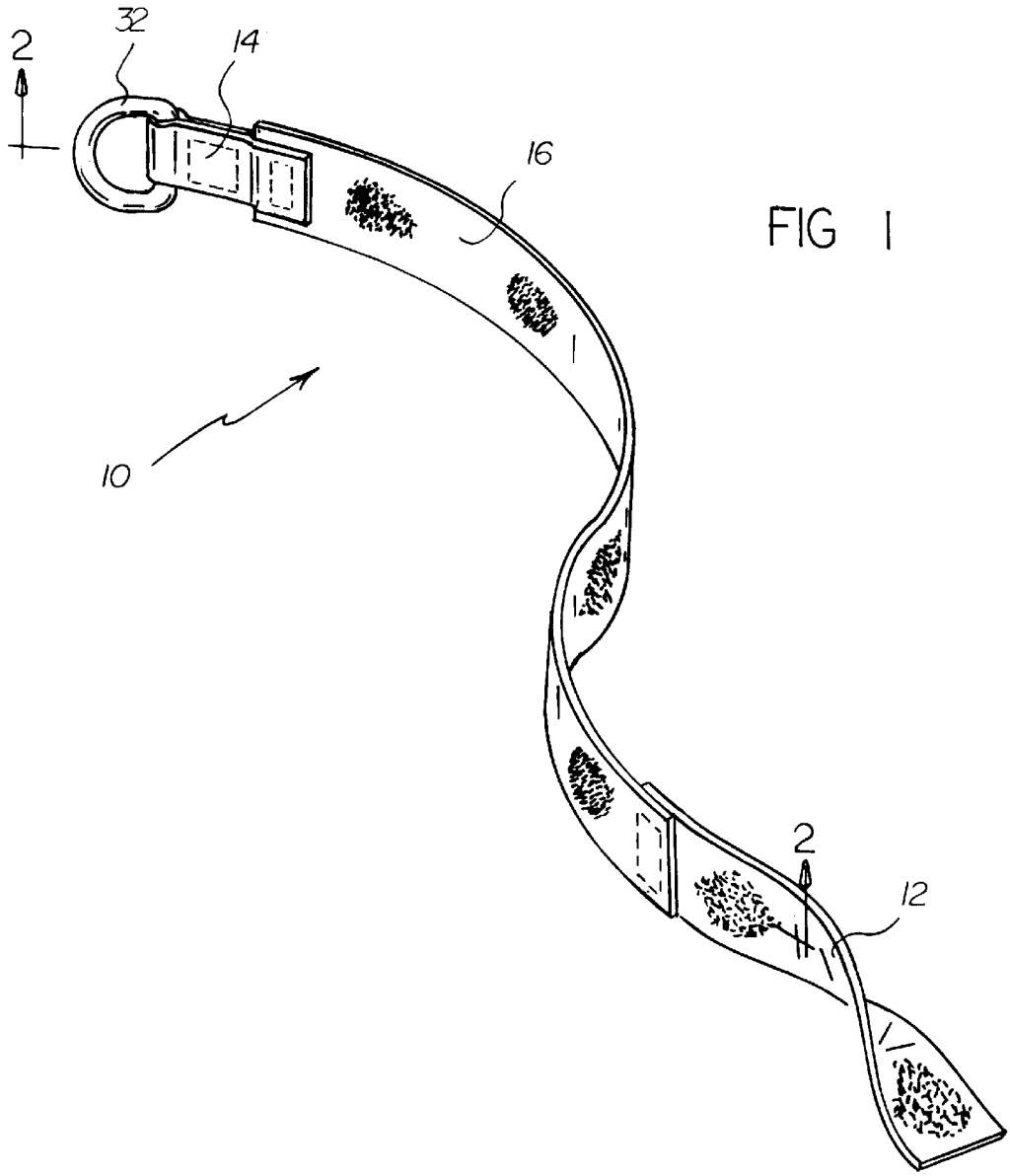
FIG. 1 is a perspective view of a first embodiment of an athletic equipment attachment strap according to the present invention.
Figure 2:
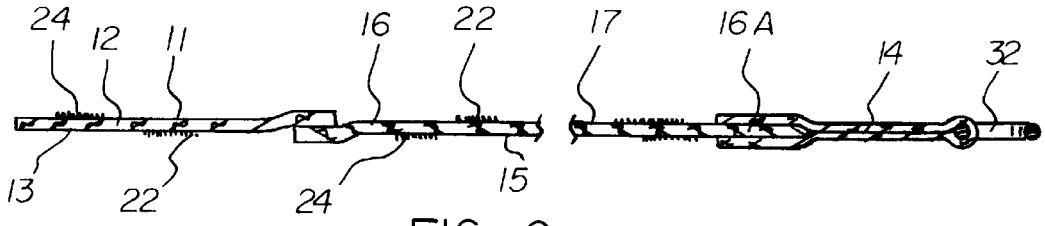
FIG. 2 is a cross-sectional view of the present invention taken along the length of the present invention.

With reference now to the drawings, and in particular to FIGS. 1 through 5 thereof, a new athletic equipment attachment strap embodying the principles and concepts of the present invention and generally designated by the reference numeral 10 will be described.

As best illustrated in FIGS. 1 through 5, the athletic equipment attachment strap 10 comprises a first substantially non-elastic strap portion 12, a webbing portion 14, and a second substantially non-elastic strap portion 16.

In use the strap 10 is formed into a substantially continuous annular band to hold a piece of athletic equipment in place against a part of a user's anatomy. The webbing portion 14 is designed for stretching a finite distance in a lengthwise direction such that the strap 10 is somewhat variable in length as the strap 10 is used.

In a first and most preferred embodiment the first strap portion 12 is coupled to said second strap portion 16 and said webbing portion 14 is coupled to an end 16A of said second strap portion opposite said first portion. The first strap portion 12 and second strap portion 16 each have a plurality of hook fasteners 22 on one side to form respective hook fastener sides 13 and 17. The first strap portion 12 and the second strap portion 16 each further have a plurality of loop fasteners 24 on an opposite side to form respective loop fastener sides 11 and 15.

The first strap portion 12 is oriented such that the hook fastener side 13 faces in a first direction while the second strap portion 16 is oriented such that said loop fastener side 15 also faces in the first direction.

A loop member 32 is coupled to the webbing portion 14 opposite the second strap portion 16. The first strap portion 12 is designed to be insertable through the loop member 32 such that either the hook fastener side 13 can be folded back to engage the loop fastener side 15 or the loop fastener side 15 can be folded back to engage the hook fastener side 17, whereby the strap 10 is formed into a substantially annular band.

Figure 3:
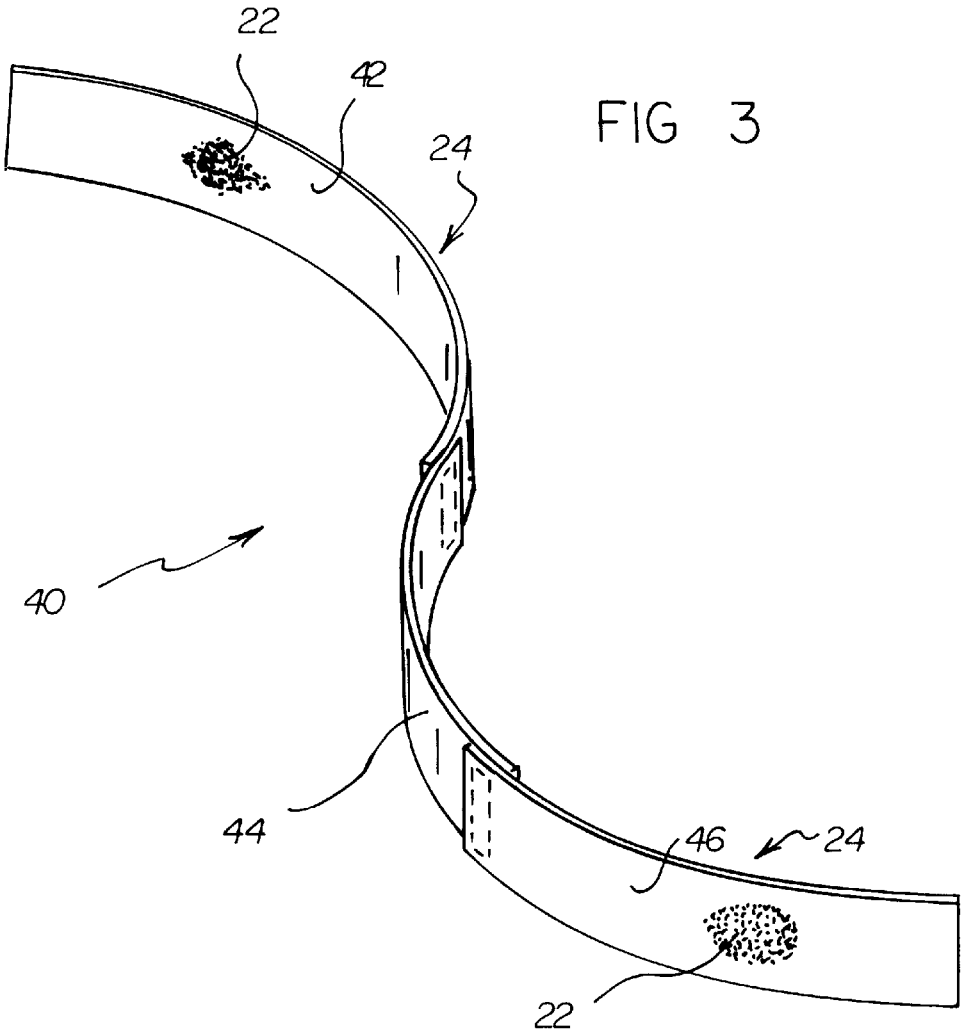
FIG. 3 is a perspective view of an alternate embodiment of the present invention.
Figure 4:
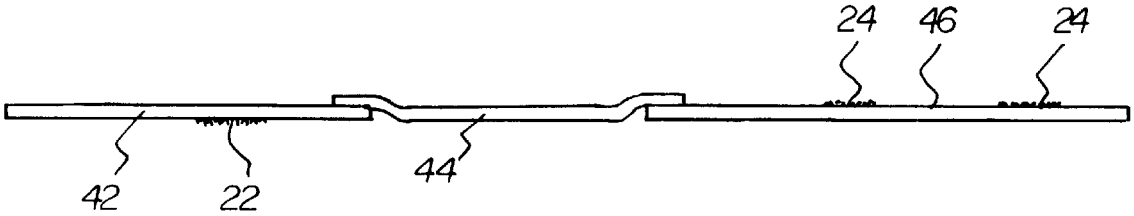
FIG. 4 is a side view of the alternate embodiment of the present invention.
Figure 5:
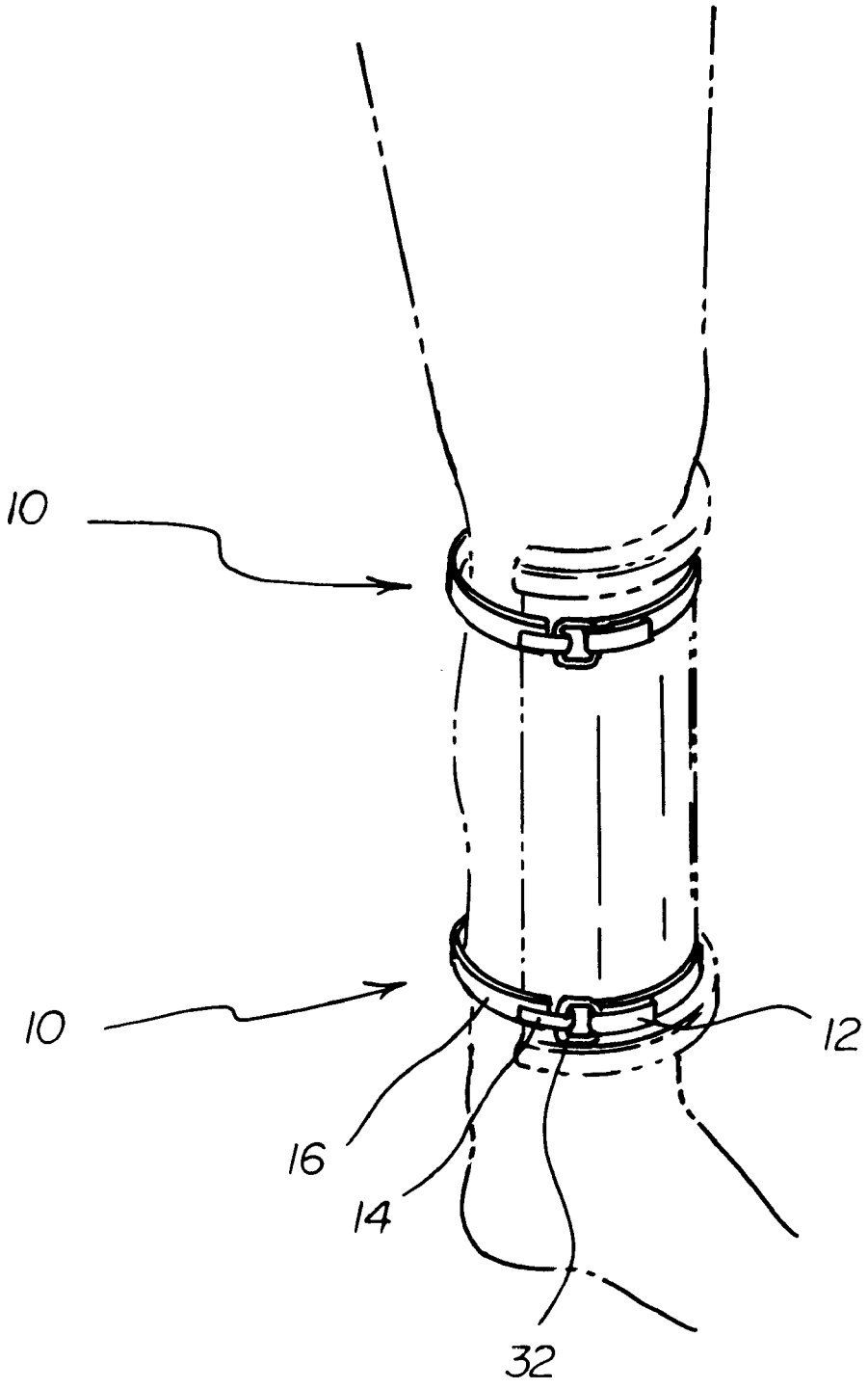
FIG. 5 is a perspective view of the first embodiment of the present invention in use.

In a second preferred embodiment, shown in FIGS. 3 and 4, the athletic equipment strap 40 has first and second non-elastic strap portions 42 and 46 respectively. The first strap portion 42 has a plurality of hook fasteners 22 on a first strap portion face 43. The second strap portion 46 has a plurality of loop fasteners 24 on a second strap portion face 45. The first strap portion 42 and second strap portion 46 are oriented such that the first strap portion face 43 and the second strap portion face 45 face opposing directions. A webbing portion 44 is coupled between an the first strap portion 42 and the second strap portion 46 to form a substantially continuous strap for wrapping around a piece of athletic equipment and a part of a user's anatomy such that the hook fasteners 22 on the first strap portion face 43 and the loop fasteners 24 on the second strap portion face 45 engage each other whereby the piece of athletic equipment is secured to the part of the user's anatomy.

FIG. 3 demonstrates that hook fasteners 22 and loop fasteners 24 may be positioned on opposite sides of the first strap portion 42 and second strap portion 46. However, the present invention is functional as displayed in FIG. 4 having only one of the hook fasteners 22 or loop fasteners 24 positioned on each of the first strap portion 42 and the second strap portion 46 as described above.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An athletic equipment strap comprising:

a first substantially non-elastic strap portion, a webbing portion, and a second substantially non-elastic strap portion;

an engagement means for engaging said first strap portion to said second strap portion such that said first strap portion, said second strap portion and said webbing portion form a substantially annular band;

said webbing portion being for stretching a finite distance in a lengthwise direction;

wherein the first strap portion is coupled to said second strap portion and said webbing portion is coupled to an end of said second strap portion opposite said first portion;

wherein the engagement means comprises said first and second strap portions each having a plurality of hook fasteners on one side to form a hook fastener side and a plurality of loop fasteners on an opposite side to form a loop fastener side;

said first strap portion being oriented such that said hook fastener side of said first strap portion faces in a first direction;

said second strap portion being oriented such that said loop fastener side of said second strap portion faces in said first direction;

a generally D-shaped loop member having a straight portion and a curved portion, said straight portion of said loop member being coupled to said webbing portion opposite said second strap portion, said curved portion being for preventing twisting of said loop member during prolonged wearing of the equipment strap by a user; and said first strap portion being insertable through said loop member such that said hook fastener side of said first strap portion can be folded back around said curved portion of said loop member to engage said loop fastener side of said second strap portion or said loop side of said first strap portion can be folded back around said curved portion of said loop member to engage said hook fastener side of said second strap portion, whereby said curved portion of said loop member is secured to said first strap portion and said second strap portion to form a substantially annular band.

2. The athletic equipment strap of claim 1 wherein the webbing portion includes a first and a second end;

wherein said webbing portion is folded over and said first and second ends of said webbing are coupled to opposite sides of said end of said second strap portion opposite said first strap portion; and wherein opposing interior portions of said webbing portion are transversely coupled to each other to form a tube in a medial portion of the webbing portion; and wherein said straight portion of said loop member is snugly positioned within said tube for preventing twisting of said loop member such that said curved portion of said loop member enters said tube.

3. The athletic equipment strap of claim 1 wherein said straight portion of said D-shaped loop member has a length approximately equal to a width of said second strap portion; and said webbing portion has a width less than said second strap portion, said webbing portion extending from a generally central portion of said end of said second strap portion opposite said first strap portion such that said D-shaped loop member is substantially aligned with said second strap portion.

4. An athletic equipment strap comprising:

a first substantially non-elastic strap portion, a webbing portion, and a second substantially non-elastic strap portion;

an engagement means for engaging said first strap portion to said second strap portion such that said first strap portion, said second strap portion and said webbing portion form a substantially annular band;

said webbing portion being for stretching a finite distance in a lengthwise direction;

wherein the first strap portion is coupled to said second strap portion and said webbing portion is coupled to an end of said second strap portion opposite said first portion;

wherein the engagement means comprises said first and second strap portions each having a plurality of hook fasteners extending along a full length of one side to form a hook fastener side and a plurality of loop fasteners extending along a full length of an opposite side to form a loop fastener side;

said first strap portion being oriented such that said hook fastener side of said first strap portion faces in a first direction;

said second strap portion being oriented such that said loop fastener side of said second strap portion faces in said first direction;

a generally D-shaped loop member having a straight portion and a curved portion, said straight portion of said loop member being coupled to said webbing portion opposite said second strap portion, said curved portion being for preventing twisting of said loop member during prolonged wearing of the equipment strap by a user; and said first strap portion being insertable through said loop member such that said hook fastener side of said first strap portion can be folded back around said curved portion of said loop member to engage said loop fastener side of said second strap portion or said loop side of said first strap portion can be folded back around said curved portion of said loop member to engage said hook fastener side of said second strap portion, whereby said curved portion of said loop member is secured to said first strap portion and said second strap portion to form a substantially annular band;

wherein the webbing portion includes a first and a second end;

wherein said webbing portion is folded over and said first and second ends of said webbing are coupled to opposite sides of said end of said second strap portion opposite said first strap portion; and wherein opposing interior portions of said webbing portion are transversely stitched to each other to form a tube in a medial portion of the webbing portion; and wherein said straight portion of said loop member is snugly positioned within said tube for preventing twisting of said loop member such that said curved portion of said loop member enters said tube.

5. The athletic equipment strap of claim 2 wherein said straight portion of said D-shaped loop member has a length approximately equal to a width of said second strap portion; and said webbing portion has a width less than said second strap portion, said webbing portion extending from a generally central portion of said end of said second strap portion opposite said first strap portion such that said D-shaped loop member is substantially aligned with said second strap portion.

6. An athletic equipment strap comprising:

a first substantially non-elastic strap portion, a webbing portion, and a second substantially non-elastic strap portion;

an engagement means for engaging said first strap portion to said second strap portion such that said first strap portion, said second strap portion and said webbing portion form a substantially annular band;

said webbing portion being for stretching a finite distance in a lengthwise direction;

wherein the first strap portion is coupled to said second strap portion and said webbing portion is coupled to an end of said second strap portion opposite said first portion;

wherein the engagement means comprises said first and second strap portions each having a plurality of hook fasteners extending along a full length of one side to form a hook fastener side and a plurality of loop fasteners extending along a full length of an opposite side to form a loop fastener side;

said first strap portion being oriented such that said hook fastener side of said first strap portion faces in a first direction;

said second strap portion being oriented such that said loop fastener side of said second strap portion faces in said first direction;

a generally D-shaped loop member having a straight portion and a curved portion, said straight portion of said loop member being coupled to said webbing portion opposite said second strap portion, said curved portion being for preventing twisting of said loop member during prolonged wearing of the equipment strap by a user; and said first strap portion being insertable through said loop member such that said hook fastener side of said first strap portion can be folded back around said curved portion of said loop member to engage said loop fastener side of said second strap portion or said loop side of said first strap portion can be folded back around said curved portion of said loop member to engage said hook fastener side of said second strap portion, whereby said curved portion of said loop member is secured to said first strap portion and said second strap portion to form a substantially annular band;

wherein the webbing portion includes a first and a second end;

wherein said webbing portion is folded over and said first and second ends of said webbing are coupled to opposite sides of said end of said second strap portion opposite said first strap portion;

wherein opposing interior portions of said webbing portion are transversely stitched to each other to form a tube in a medial portion of the webbing portion;

wherein said straight portion of said loop member is snugly positioned within said tube for preventing twisting of said loop member such that said curved portion of said loop member enters said tube;

wherein said straight portion of said D-shaped loop member has a length approximately equal to a width of said second strap portion; and said webbing portion has a width less than said second strap portion, said webbing portion extending from a generally central portion of said end of said second strap portion opposite said first strap portion such that said D-shaped loop member is substantially aligned with said second strap portion.

* * * * *